US005848507A

United States Patent [19]

Bozich

[11] Patent Number: 5,848,507

[45] Date of Patent: Dec. 15, 1998

[54] ENCLOSURE WITH EXTERNALLY MOUNTED ADJUSTABLE FOUNDATIONS

[75] Inventor: Robert A. Bozich, Eveleth, Minn.

[73] Assignee: Malton Equipment Company, Virginia, Minn.

[21] Appl. No.: 915,880

[22] Filed: Aug. 21, 1997

[51] Int. Cl.[6] ..... E04B 1/343

[52] U.S. Cl. ..... 52/299; 52/64; 52/67; 52/126.5; 403/378

[58] Field of Search ..... 52/64, 299, 278, 52/67, 126.5, 126.6; 248/188.5, 188.6; 403/104, 109, 377, 378

[56] References Cited

PUBLICATIONS

Color photograph: Two views of outbuilding with metal footings (origin and date unknown).

*Primary Examiner*—Carl D. Friedman
*Assistant Examiner*—Phi Dieu Tran A
*Attorney, Agent, or Firm*—Merchant, Gould, Smith, Edell, Welter & Schmidt, P.A.

[57] ABSTRACT

A railroad bungalow having a roof, a floor and adjoining walls forming vertically extending corners. An elongated guide sleeve is mounted on the exterior surface of each corner forming a guide slot. A support leg in the shape of an angle iron is movably mounted in each guide slot. The legs are provided with spaced openings and corresponding openings are provided in the sleeve and wall so that a pin or bolt can be inserted to hold the leg at a selected position to adjust the height of the bungalow above a supporting surface.

12 Claims, 4 Drawing Sheets

ENCLOSURE WITH EXTERNALLY MOUNTED ADJUSTABLE FOUNDATIONS

FIELD OF THE INVENTION

This invention relates generally to adjusting the height of railroad bungalows above a supporting surface, and more particularly to a railroad bungalow having guide sleeves secured to vertical corners forming a guide slot at each corner in which a support leg is mounted, with locking means being provided to hold the legs at selected positions to adjust the height of the bungalow above a supporting surface.

BACKGROUND OF THE INVENTION

Metal buildings called bungalows have been used at railroad crossings to house the electrical and electronic systems used to control crossing signals and related apparatus. In the past, a concrete foundation has been poured with anchor bolts to connect to and support the bungalow. Because the trains shake the ground as they pass the bungalow, the concrete foundation often settles so that it is no longer level. This may cause problems with the equipment or connections, and because the building is not stable it is not feasible to use the building to support signal lights.

Bungalows have been modified in the past to permit leveling by using tubular legs which extend upwardly through openings in the floor and which are provided with spaced openings so that a long pin or bolt can be inserted in a selected opening, through a side wall, after the length of the tube is adjusted, to support the building at a desired level. However, these have been difficult to adjust and because both the tubes and bolts go through openings into the building there is a potential for moisture, animals or insects to enter the building through the openings. Thus, prior attempts to provide means to level the bungalow have not been fully accepted or utilized by the industry.

SUMMARY OF THE INVENTION

The present invention provides a modification to the structure of the bungalow which permits it to be easily adjusted with respect to a supporting surface. Each vertical corner of the bungalow is provided with an elongated guide sleeve mounted on the exterior surface forming a vertically extending guide slot at each corner between the adjoining walls of the building and the sleeve. A leg in the form of an angle iron is movably positioned in each guide slot so that the legs can be extended a selected distance downwardly from the floor of the bungalow to adjust the height of the bungalow above a supporting surface. Means are provided to lock the legs in place at selected positions to level the bungalow and maintain it at the selected height above the surface.

With this arrangement, a concrete foundation is not usually necessary. Crushed rock can be poured on the ground and then the building placed on the rock, supported by the extended legs. The crushed rock is then filled in up to the bottom of the building. The legs can be adjusted at any time to level the building so that for example, if one corner of the building sinks, that corner leg can be extended further and locked in place to again level the building.

This arrangement has many advantages because the guide sleeves and legs are all exterior of the building so that they do not take up any space inside the building. Further, if aligned holes and pins are used to lock the legs in place, the holes do not need to extend into the building, thereby making the building easier to heat if necessary and preventing the entrance of moisture or animals. The roof normally overhangs the bungalow so that it covers the sleeves on the corners and the sleeves can be designed to aesthetically blend into the visual appearance of the structure. The exterior mounted legs also give the building a wide stance, and because of that and the ability to adjust the level of the bungalow at any time, it can be used to support heavy signal lights close to the track.

These buildings can be used not only in railroad applications but also in control, signalling and communications applications, as for example, microwave tower applications.

DESCRIPTION OF THE PREFERRED EMBODIMENT

Figure 1:
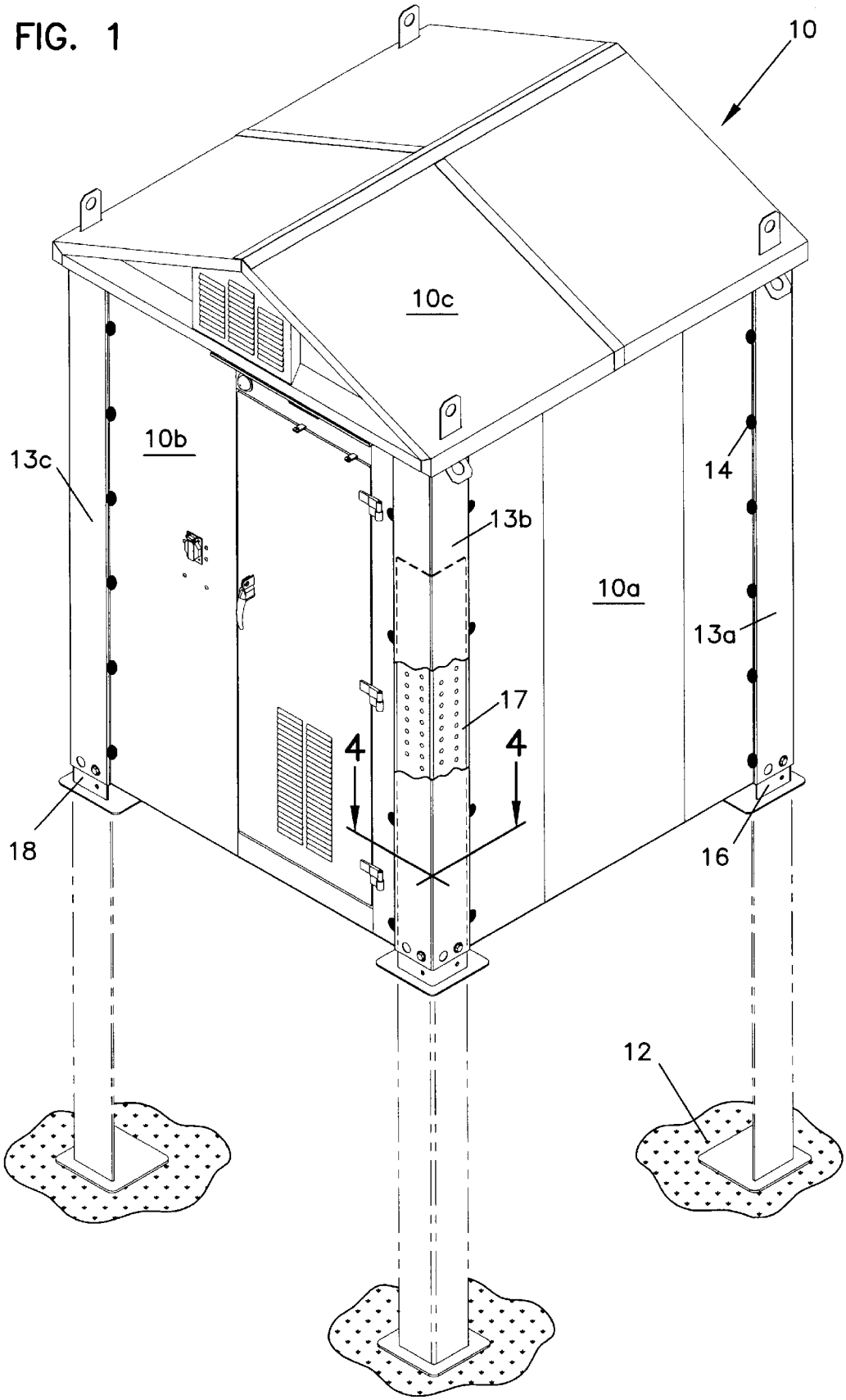
FIG. 1 is a front, side and top view in perspective of a railroad bungalow having adjustable support legs, with the legs in phantom being shown in an extended position.
Figure 2:
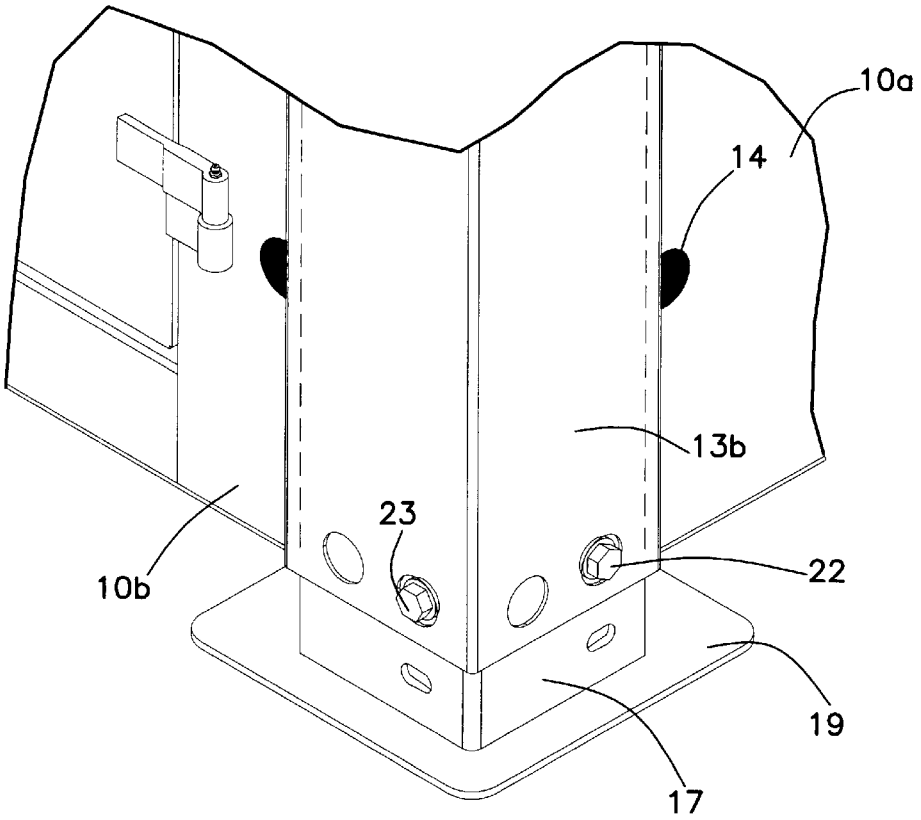
FIG. 2 is a fragmentary, enlarged view of the bottom front corner of the bungalow shown in FIG. 1.
Figure 3:
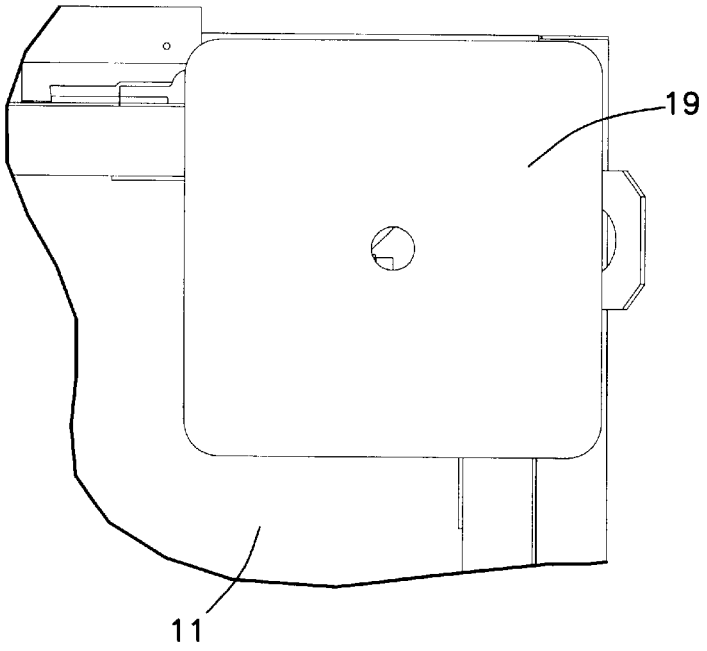
FIG. 3 is a fragmentary, enlarged bottom plan view of the bungalow corner and leg shown in FIG. 2.
Figure 4:
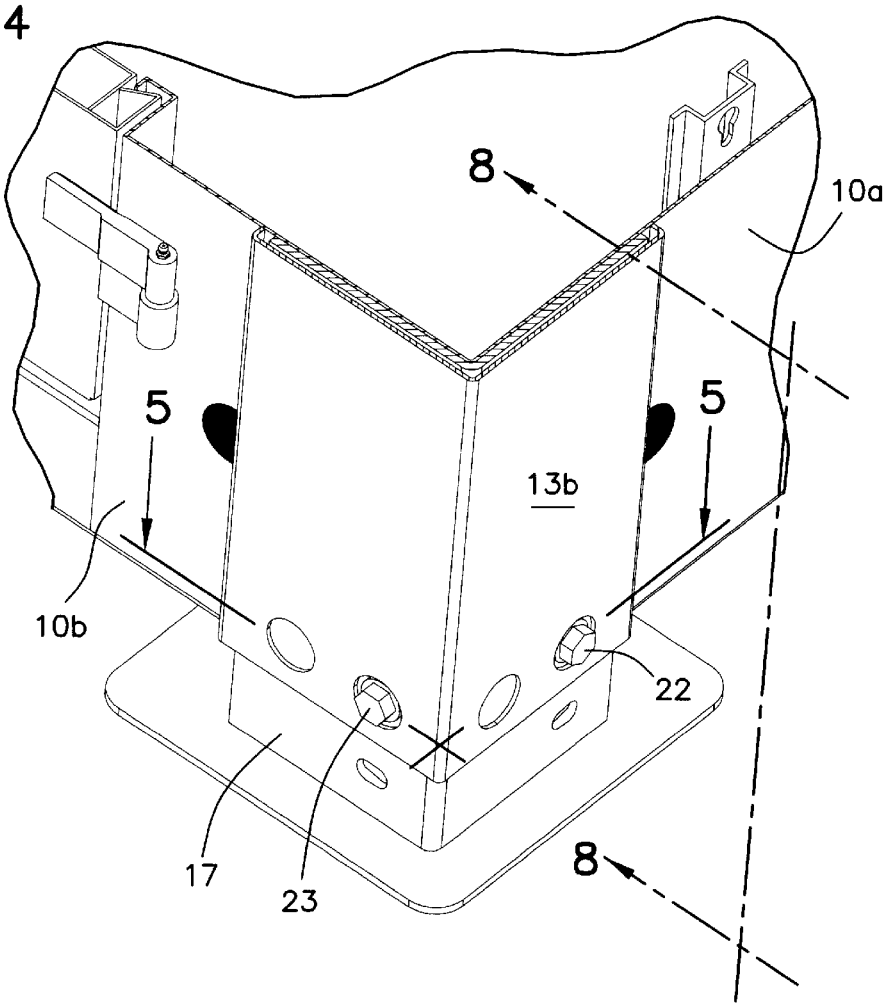
FIG. 4 is a fragmentary sectional view similar to FIG. 2, with the section taken along line 4—4 of FIG. 1.

Referring now to the drawings, wherein like numerals will be used throughout the several views to identify like elements of the invention, there is disclosed a building in the nature of a railroad bungalow 10 having four side walls, two of which 10*a* and 10*b* are shown, and a roof 10*c*. Bungalow 10 has a floor 11 shown in FIG. 8, which is a planar panel extending in a plane parallel to a supporting surface 12. Bungalow 10 is usually a metal building constructed from aluminum or steel panels so that it can withstand exposure to the elements. In this preferred embodiment, bungalow 10 is made from aluminum panels and has a rectangular cross-section taken in a plane parallel to the plane of floor 11 with the adjoining four walls forming vertically extending corners from the roof 10*c* down to below floor 11.

Figure 5:
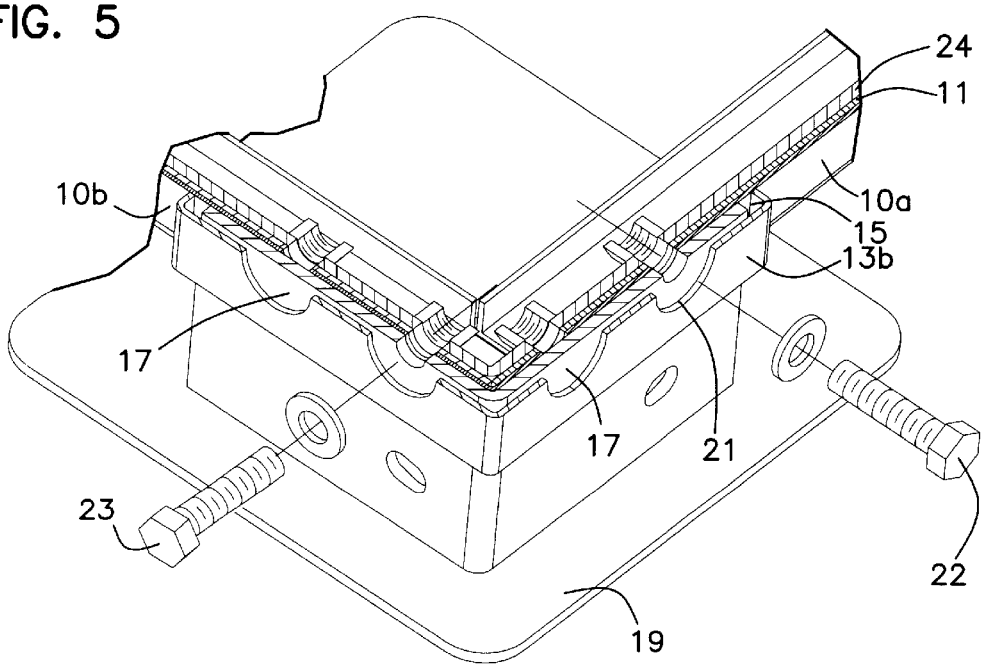
FIG. 5 is an enlarged, partially exploded view, in section, similar to FIG. 4, with the section taken along line 5—5 of FIG. 4.

Each of the four corners is provided with an elongated guide sleeve, with sleeves 13*a*, 13*b* and 13*c* being shown in FIG. 1. Each guide sleeve is mounted on the exterior surface of each corner to form a guide slot at each corner between the adjoining walls at the corner and the guide sleeve. The guide sleeves are spot welded to the walls along the opposite edges thereof, as depicted by the black dots 14 in the drawings. Referring to FIG. 5, it can be seen that guide sleeve 13*b* is secured to walls 10*a*, 10*b* to form a guide slot 15 there between. Each guide sleeve such as 13*b* is formed to have a pair of flat, elongated walls connected at adjoining edges to form a 90 degree angle in cross-section with the outer edges being bent inwardly at right angles for connection to the walls 10*a*, 10*b* and to space the guide sleeve a selected distance from the building walls to define the guide slot 15.

Figure 7:
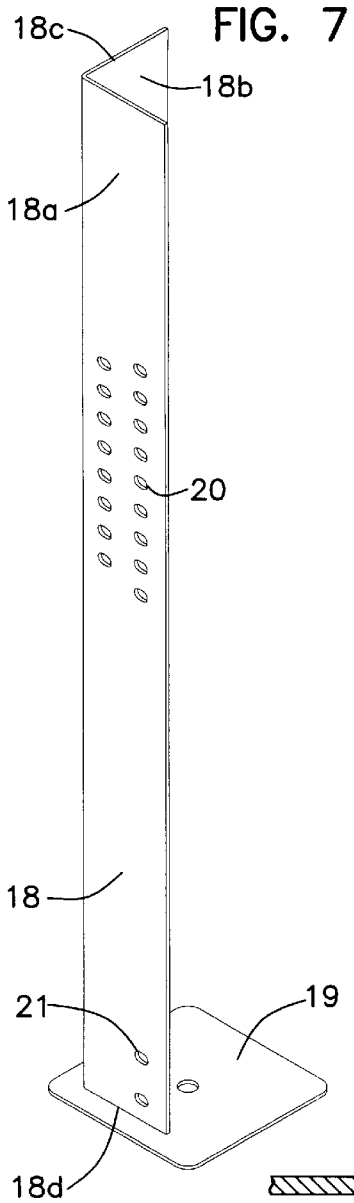
FIG. 7 is a view in perspective of one of the legs.
Figure 6:
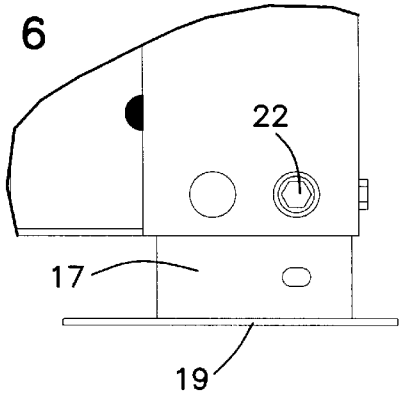
FIG. 6 is a fragmentary plan view of the bungalow corner taken from the left side of FIG. 2.

Adjustable support legs are provided for each corner with support legs 16, 17 and 18 being shown in FIG. 1. The four legs are all identical in construction. Leg 18, as shown in FIG. 7, comprises a pair of elongated plates connected perpendicular to each other at adjoining edges to form a leg in the shape of an angle iron. Leg 18 has a top end 18*c* and a bottom end 18*d*. Bottom end 18*d* is welded to a flat rectangular plate 19 forming a footing which rests on the supporting surface 12. The legs are preferably made of steel in the shape of an "angle iron" so that the legs are rigid and will not easily bend or twist.

Support legs 16, 17 and 18 are mounted in guide slots 15 at the three corners shown in FIG. 1 with the legs being adjustable from a position with the leg inserted fully into the guide slot so that the plates 19 are located just below walls 10*a*, 10*b*, and an extended position as shown in phantom in FIG. 1, where the bungalow 10 is being supported with floor 11 being spaced from the supporting surface 12 by the legs with the bottom ends and plates engaging the supporting surface 12. It can be seen that the legs are movably positioned in the guide slots for movement between a position with the bottom end adjacent the floor and an extended position spaced from the floor.

In the preferred embodiment, the guide sleeves extend the full length of each corner but a series of spaced guide sleeves at each corner would accomplish the same function. In some applications, the guide sleeve might also comprise a pair of L-shaped guide members attached to the walls forming slots to accommodate the opposite edges of the legs. Generally speaking, the invention contemplates that the legs will be movably mounted at the corners of the building, on the exterior surface, with some form of guide slot being provided on the exterior surface to hold the legs in place while permitting axial movement thereof to adjust the height of the building.

Means are also provided for holding the legs at selected positions to adjust the height of the bungalow 10 above the supporting surface 12. In the preferred embodiment, the adjusting and holding means comprise two rows of axially extending spaced openings 20 formed in each plate such as 18*a*, 18*b* forming each leg such as leg 18. Each opening has an oval shape with a long dimension extending horizontally and the two rows of openings are staggered vertically to increase the number of adjustments that can be made. A pair of vertically spaced openings 21 are also provided at the bottom end of each leg.

Figure 8:
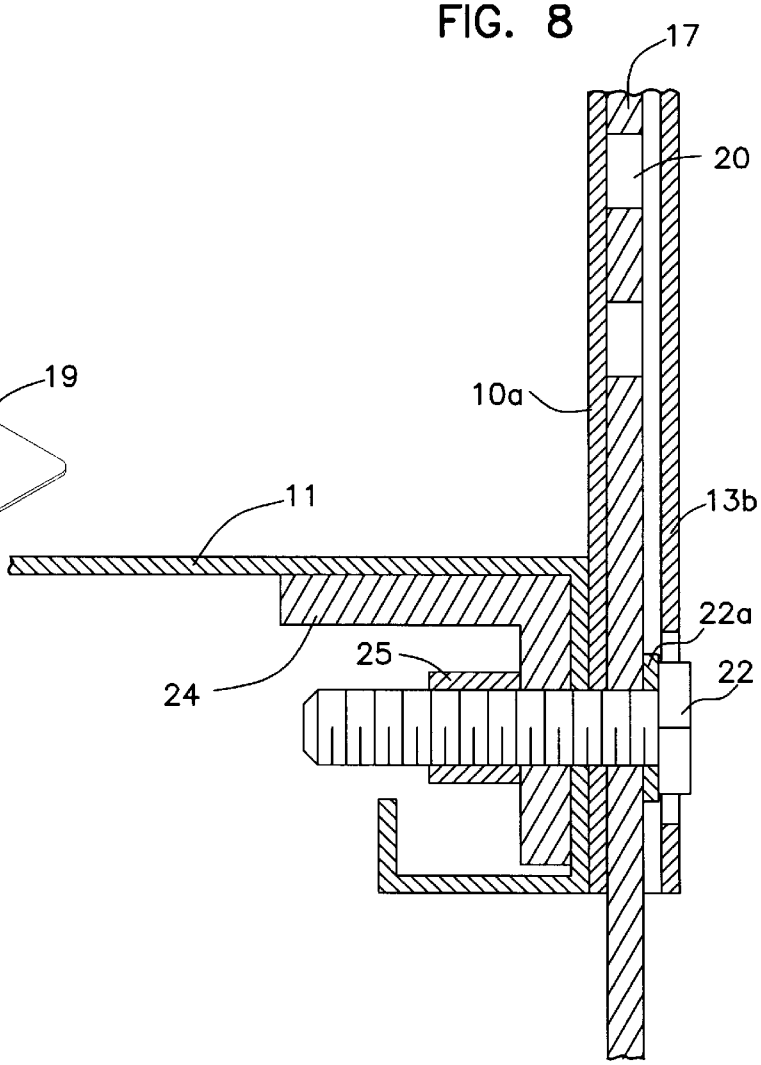
FIG. 8 is an enlarged, vertical, fragmentary sectional view of the bungalow corner taken along line 8—8 of FIG. 4.

The bottom end of each guide sleeve 13 is provided with four horizontally spaced openings, two in each plate, to accommodate locking bolts such as bolts 22, 23 shown in FIG. 5. Referring to FIG. 8, it can be seen that steel bolt 22 and an accompanying washer 22*a* extends through an opening 21 in sleeve 13*b*, an opening 20 in leg 17 and corresponding openings in wall 10*a*, a vertical extension of floor 11 and a reinforcing angle iron 24 for engagement with a threaded nut 25 welded to an inner surface of angle iron 24. Opening 21 is large enough to accommodate a wrench so that bolt 22 can be tightened to press leg 17 tightly against wall 10*a*.

The legs can be held in the upward position shown in FIG. 5 by inserting the bolts 22, 23 through selected openings 21 at the bottom ends of the legs. The legs can be held in this position for shipment to the site and may be left in that position for some applications.

Although a specific locking means in the form of a bolt and nut are shown to lock the legs in place, other locking means can be used if desired. For example, a pin held in place by a cotter pin or a clip could be used instead of a bolt and nut arrangement. Another option would be to weld the nut to the sleeve so that the bolt would extend only through the sleeve and leg and in that case it would not be necessary to have an opening through the wall. In other applications, a pin might be extended through an opening in the leg below the sleeve and wall because the weight of the building on the pin would tend to hold it in place. Other known locking arrangements could be used without departing from the invention.

If it is desired to position the bungalow 10 a selected distance above the ground, the bolts are removed, the building is lifted and the legs are extended until one of the selected openings 20 is positioned in line with the other openings as shown in FIG. 8, at which point the bolt is again inserted and threaded down to lock the leg in place. The extended length of each leg can be adjusted separately to level the building as necessary, at any time.

The staggered bolt opening design (2 on each side of each leg) provides adjustments in one-inch increments in the preferred embodiment, or less if desired, and permits the use of large fasteners, typically ⅝ inch bolts. The oval shapes of the openings permit the bolts to be easily inserted even if all of the components are not perfectly aligned. The bungalow can be installed on conventional concrete foundations or pillars, or can be placed directly on the ground surface which is then usually covered with crushed rock to better support the legs. The exterior corner angle legs and guide sleeves provide better stability and support capabilities than the prior art pipe-style adjustable legs, because the legs are positioned on the bungalow corners rather than inwardly of the corners. A 6'×6' bungalow is thus supported on a 6'×6' square with this invention, whereas the prior art pipe foundations supported a 6'×6' building on a 5'×5' square. The corner guide sleeves and legs also provide improved protection from impact or collision, and because the adjustable legs do not intrude into the bungalow interior, both insect entrance and energy loss from air filtration are eliminated. Further, because the corner leg foundations do not protrude into the interior, they do not reduce the usable floor space in a typical bungalow. Because the angle iron legs and guide sleeves reinforce the building corners and roof, it is now possible to attach roof-mounted equipment or accessories on the bungalow.

Although this invention has been described in considerable detail, such description is intended as being illustrative rather than limiting, since the invention may be variously embodied, and the scope of the invention is to be determined as claimed.

Having thus set forth and disclosed the nature of this invention, what is claimed is:

1. A railroad bungalow, comprising:

(a) an enclosed structure having a roof, a floor and a rectangular cross-section with adjoining walls forming vertically extending corners;

(b) an elongated guide sleeve mounted on the exterior surface of each corner forming a guide slot at each corner extending above said floor between said adjoining walls and said sleeve;

(c) an adjustable support leg for each corner, each having a top end and a bottom end, and each comprising a pair of elongated plates connected perpendicular to each other at adjoining edges;

(d) said bungalow being supported with said floor being spaced from a supporting surface a desired distance by said legs with said bottom ends engaging the supporting surface;

(e) said legs being movably positioned in said guide slots for movement between a position with a bottom end adjacent said floor and an extended position spaced from said floor; and (f) means for holding said legs at selected positions to adjust the height of said bungalow above the supporting surface.

2. A railroad bungalow according to claim 1 wherein said legs are angle irons having spaced openings formed therein along a selected portion of the length of each leg, wherein aligned openings are formed in said sleeve and said exterior surface, and wherein pins are provided to extend through said openings to hold the legs in place.

3. A railroad bungalow according to claim 2 wherein each said plate has two spaced rows of openings with one row staggered from the other and wherein corresponding pairs of openings are provided in said sleeve and said exterior surface.

4. A railroad bungalow according to claim 2 wherein said spaced openings are generally oval shaped with a long dimension of each extending in a direction generally parallel to said floor.

5. A railroad bungalow according to claim 2 wherein said aligned openings are located below the level of said floor.

6. A railroad bungalow according to claim 3 wherein a plate is attached to the bottom of each leg to provide additional surface area to support said bungalow.

7. An enclosure with externally mounted, adjustable foundations, comprising:

(a) an enclosed building having walls extending above a floor, forming generally vertically extending corners;

(b) a guide sleeve mounted on the exterior surface of each corner forming a guide slot at each corner extending above said floor between said adjoining walls and said sleeve;

(c) a support leg for each corner;

(d) each said leg being movably positioned in a guide slot for movement between a non-extended position and an extended position; and (e) means for locking said legs at selected positions.

8. An enclosure according to claim 7 wherein said legs have spaced openings formed therein, wherein aligned openings are formed in said sleeve and said exterior surface, and wherein locking pins are provided to extend through said opening for locking said legs at selected positions.

9. An enclosure according to claim 7 wherein said enclosed building has a floor, wherein said walls extend below said floor, and wherein said means for locking said legs at selected positions comprise aligned openings in said sleeve, said leg and said wall below the level of said floor, and locking pins to extend through said openings.

10. An enclosure according to claim 8 wherein said legs are angle irons and wherein each said guide slot is constructed and arranged to extend around each said corner to form guide slots similar in shape to said angle irons.

11. An enclosure according to claim 10 wherein each angle iron comprises a pair of elongated plates connected perpendicular to each other at adjoining edges, and wherein each said plate has two spaced rows of openings with one row staggered from the other and wherein corresponding pairs of openings are provided in each said sleeve and said wall.

12. An enclosure according to claim 11 wherein said spaced openings are generally oval shaped with a long dimension of each extending generally horizontally.

* * * * *